United States Patent [19]

Hall et al.

[11] Patent Number: 4,834,621

[45] Date of Patent: May 30, 1989

[54] AIR THROTTLING VALVE FOR SUBMERGED PUMP SYSTEM

[75] Inventors: Keith Hall, Whittier, Calif.; Robert L. Esvang, Jr., Schaumburg; Ralph N. DiLorenzo, Rolling Meadows, both of Ill.

[73] Assignee: Apco/Valve and Primer Corporation, Schaumburg, Ill.

[21] Appl. No.: 124,503

[22] Filed: Nov. 24, 1987

[51] Int. Cl.[4] ..... F04B 39/00; F03B 13/02

[52] U.S. Cl. ..... 417/297; 417/501; 137/217

[58] Field of Search ..... 417/434, 435, 440; 415/901; 137/526

[56] References Cited

U.S. PATENT DOCUMENTS

| | | | |
|---|---|---|---|
| 1,028,722 | 6/1912 | Hess | 417/434 |
| 1,104,869 | 7/1914 | Bowser | 137/526 |
| 2,646,059 | 7/1953 | Wittner | 137/217 |
| 3,228,343 | 1/1966 | Anton et al. | 415/501 |
| 3,276,384 | 10/1966 | Boone | 415/501 |
| 3,434,430 | 3/1969 | Berman | 415/501 |
| 3,943,958 | 3/1976 | Davis | 417/435 |
| 4,436,107 | 3/1984 | Persson | 137/526 |

*Primary Examiner*—William L. Freeh

*Attorney, Agent, or Firm*—Cushman, Darby & Cushman

[57] ABSTRACT

In a submerged pump system for pumping liquid from a well or vessel the vertical pipe through which the liquid is pumped by a submerged impeller pump is typically fitted at its upper end with an air valve. The air valve vents air from the pipe to atmosphere upon pump start up, then closes so that only water passes through a check valve to a pipe system and subsequently allows air to re-enter the pipe when the pump stops. A special throttling valve associated with the air valve restricts the outward rate of flow of air to atmosphere to thereby reduce the rate of the rising liquid and thus the shock of this liquid on the air valve and on the check valve but allows essentially unrestricted re-entry of atmospheric air to thereby allow the vertical pipe to fill with air rapidly. One form of throttling valve includes a valve plug mounted for axial movement into and out of a vent opening and spring-biased into the opening. The plug is a loose fit within the opening, so that during venting the air passes through the restricted space between the plug and the wall of the opening. Upon re-entry of air the force of the entering air moves the valve plug against the spring bias and out of the opening in the direction of air flow whereby the opening is no longer restricted by the plug.

5 Claims, 3 Drawing Sheets

AIR THROTTLING VALVE FOR SUBMERGED PUMP SYSTEM

This invention relates to pump systems of the kind having a submerged pump and a vertical pipe through which liquid is pumped to a piping system. In particular, the invention relates to valves for venting air from the vertical pipe and permitting re-entry of air into the pipe and more in particular to a special throttling valve which controls the flow rate of vent air and re-entry air.

BACKGROUND OF THE INVENTION

One form of submerged pump system includes a vertical turbine pump which in use is submerged in water or other liquid within a well or vessel for the purpose of pumping the liquid upwardly through a pipe to a discharge point. A typical pump of this kind includes, as its essential components, a vertical stack of impellers mounted on a motor-driven vertical shaft and shrouded within housings, the lowermost housing having an inlet open to the water when the pump is submerged. When the shaft rotates, the impellers rotate within the housings thereby lifting water from the inlet to each successive impeller. The combined action of the impellers creates sufficient force to pump water to the top of the well through a vertical pipe, commonly referred to as the suction pipe, the lower end of which is connected to the uppermost housing. Such pumps are capable of pumping water from wells in which the water level is many hundreds of feet below the top of the well. Typically the motor is mounted at the top of the well with its output shaft coaxial with the impeller shaft, and the water discharge opening at the top of the well faces laterally and is connected to a conduit which conveys the water to a water system.

A pumping system which utilizes a submerged pump such as a vertical turbine pump typically includes a check valve installed between the discharge opening of the suction pipe and a conduit which conveys the water away from the opening. The check valve opens under the force of the pumped water so as to pass the water into the conveying conduit and closes under the force of water tending to flow in the opposite direction.

When the pump is not operating, that is when the impellers are not rotating, the portion of the suction pipe between the water level in the well and the discharge opening is filled with air. When the pump starts, this air must be exhausted to atmosphere and not be pushed by the force of the pump out the discharge, through the check valve and into the downstream water system. If the air enters the water system, various problems may result, including water hammer and pressure surges which are capable of causing damage to the pump, the piping in the water system, water meters and other sensitive water control devices. Typically, upon pump start-up, the air in the suction pipe is discharged to atmosphere through a valve, commonly referred to as an air and vacuum valve or simply an air valve, located between the discharge opening and the check valve. Such air valves are usually float valves which comprise a housing in communication with the suction pipe, a vent communicating with atmosphere and a buoyant float in the housing, the float rising to close the vent when water enters the housing due to operation of the pump. When the pump stops, water drains from the valve housing, allowing the float to move downwardly and open the vent, so that ambient air can re-enter and flow into the upper end of the suction pipe. The re-entering air allows the water in the suction pipe to flow back through the impellers into the well until the water level in the suction pipe is the same as the water level in the well. Allowing the water to return to water level is a necessary feature in order to prevent the creation of negative pressure (vacuum) in the suction pipe, because the negative pressure puts a strain on the pump shaft seals and various couplings and expansion joints which may be present. Also, the reverse flow of water causes the pump impellers to rotate in the reverse direction; this back-spin is an inherent disadvantage, because should the pump be called to start again while in reverse rotation, the resulting stress on the pump shaft could cause the latter to break.

Another conventional feature which can be incorporated into the pumping system so far described is an air throttling valve which is fitted to the vent opening of the air valve. A throttling valve is simply a flow restriction device which restricts the flow rate of venting air and thereby creates a back pressure on the rising column of water during start-up of the pump. This back pressure reduces the rate at which the water rises in the suction pipe thereby reducing the shock effect of the water on the valve-closing mechanism of the air valve and on the valve-opening mechanism of the check valve. The air valve, if its structural and operating characteristics are closely matched to the pump capacity and other variables of the pumping system, will itself compensate for the shock effect of the rising water and in such a situation no throttling valve would be necessary. As a practical matter, it is often useful to incorporate a throttling valve and then manually adjust the restricting effect of the latter to produce the desired degree of throttling for the particular system.

Conventional throttling valves have, however, an inherent disadvantage in that they also restrict the flow of re-entry air when the pump stops. The result is that the column of water in the suction pipe drops rather slowly, thus increasing the time period during which the impellers are caused to rotate in the reverse direction and during which the shaft seals and other components are under vacuum stress. The potential hazard of shaft breakage if the pump receives a start signal during this time period, as discussed previously, is thus increased. The present invention provides an improved throttling valve which allows essentially unrestricted flow of re-entry air, thus overcoming these disadvantages of conventional throttling valves.

SUMMARY OF THE INVENTION

As mentioned directly above, the present invention relates to an improved throttling valve for use with an air valve in a submerged pump pumping system. The essential feature of the improved valve is that it produces the desired restriction to vent air passing to atmosphere but presents essentially no restriction to re-entry air. In a simple form the valve includes a housing having an inlet connectable to the air valve outlet and an outlet opening in communication with the atmosphere. A movable valve member in the housing assumes, during venting, a flow-restricting position with respect to a portion of the internal passage through the valve. In response to a reduction in pressure in the housing resulting from pump stoppage and consequent fall of water in the suction pipe, the valve member moves relative to the housing to remove or reduce the flow-restricting effect. In such a valve the valve member can be a disc mounted for sliding movement along a rod which is coaxial with the valve outlet opening. The disc is a loose fit in the outlet opening and is spring-biased in the direction of venting air into engagement with a stop on the rod. In this position the disc lies very close to or within the outlet opening, and air moving in the venting direction passes through a restricted space between the periphery of the disc and the wall of the opening. The pressure of the venting air is greater than atmospheric pressure and hence the venting air presses on the inner face of the disc and tends to hold the disc in its restricting position. When the pump stops, the water in the suction pipe begins to fall, creating a vacuum in the suction pipe which is transmitted to the housing of the throttling valve. Atmospheric pressure against the outer face of the disc is then greater than the air pressure on the inner face of the disc. As a result, the disc moves along the rod in the opposite direction, away from the outlet opening and against the spring bias, thereby fully opening the outlet opening. The described arrangement, while not the only suitable arrangement, has the advantage that the axial position of the rod and hence the valve disc can be made adjustable, as by having a threaded portion of the rod project through a complementary threaded bore in the valve housing.

DETAILED DESCRIPTION

Figure 1:
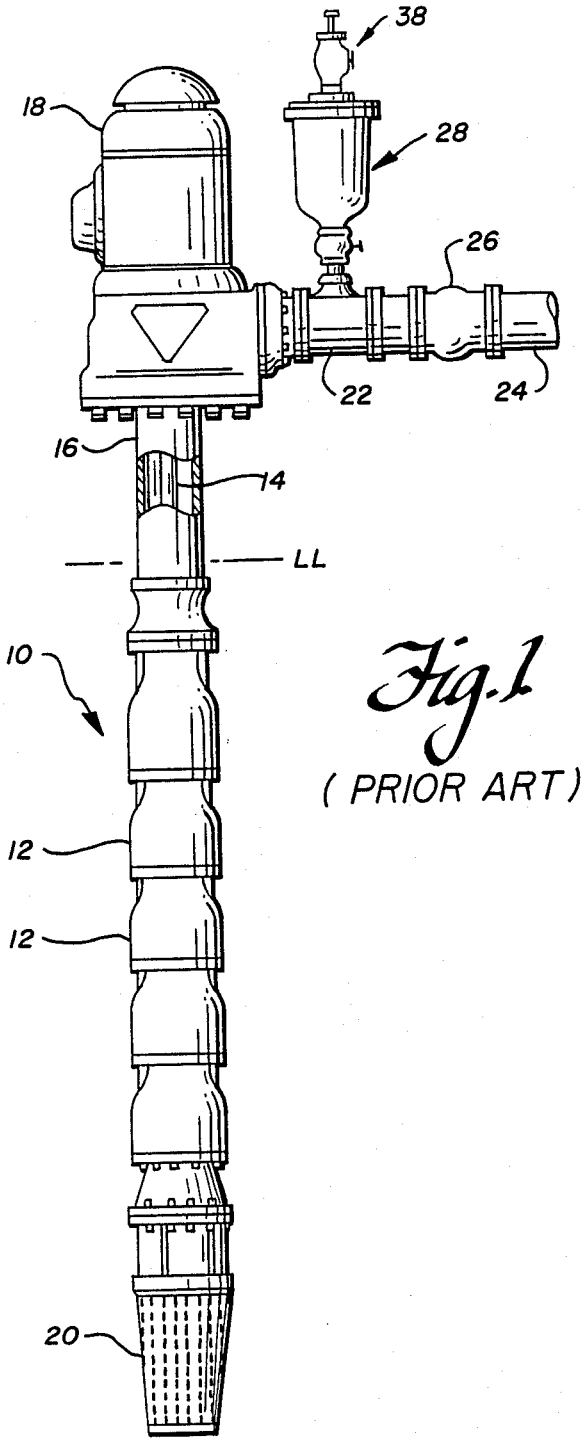
Fig. 1 ( PRIOR ART )
FIG. 1 is an elevational view of a vertical turbine pump fitted with an air and vacuum valve, as known in the prior art.

FIG. 1 illustrates an example of a known vertical turbine pump system. Typically such a system includes a pump assembly 10 which includes a plurality of vertically stacked impellers (not shown) each shrouded within a housing 12 and mounted on a common vertical shaft 14. The uppermost impeller housing 12 is connected to the lower end of a vertical suction pipe 16 through which the shaft 14 extends to a motor assembly 18 mounted on the upper end of the pipe 16. Upon rotation of the shaft 14 and impellers, liquid is drawn into an inlet 20 at the lower end of the suction pipe 16 and is forced upwardly from one impeller to the next and then up through the suction pipe 16. At the upper end of the pipe 16 the pumped liquid is discharged laterally through a discharge pipe 22. The discharge pipe 22 is connected to a conduit 24 which passes the liquid to any of a variety of piping systems (not shown). A check valve 26 connected between the discharge pipe 22 and the conduit 24 passes liquid in the discharge direction and prevents liquid flow in the opposite direction.

In communication with the pipe 16 on the discharge side of the pump assembly 10 is an air and vacuum valve 28. Conveniently this valve 28 can have its inlet 30 connected directly to the discharge pipe 22. One function of the valve 28 is to vent air from the suction pipe 16 upon start-up of the pump. As the liquid in the pipe 16 is pushed from liquid level LL to the discharge pipe 22, the air above the rising column of liquid is forced through the valve inlet 30 and out through the valve outlet 32. When liquid enters the valve inlet 30 it causes a valve mechanism, usually including a float valve 34, to close the outlet 32. A wide variety of such valves are known, and no detailed description is necessary here.

Connected to the outlet 32 of the air and vacuum valve 28 is the inlet 36 of a known air throttling valve 38. The outlet 40 of the throttling valve 38 is in communication with the atmosphere. The flow of air through the throttling valve 38 is restricted by a valve member 42 which partially restricts but does not close the internal passage 44 through the valve 38. The valve member 42 is fixed to the lower end of a vertical rod 46 or bolt which is threaded through the valve housing. Manual rotation of the rod 46 changes the axial position of the rod 46 and hence the vertical position of the valve member 42 in the passage 44. If a lesser restriction to air flow is needed, the rod 46 is unscrewed to raise the valve member 42 and thereby increase the effective cross-section of the passage 44. Greater restriction to air flow is obtained by screwing the rod 46 downwardly to thereby reduce the effective cross-section of the passage 44. A lock nut 48 permits the rod 46 to be locked in the desired position.

As described previously, the function of the air throttling valve 38 is to create a back pressure on the rising column of liquid in the suction pipe 16 upon pump start-up. The back pressure slows the rise of the liquid so that the shock of the liquid reaching the air and suction valve 28 and the check valve 26 is reduced. Upon stopping of the pump the liquid in the suction pipe 16 starts to fall toward liquid level LL, thus drawing in atmospheric air through the valves 38 and 28. The valve member 42 of the throttling valve 38 continues to exert its flow-restricting effect, however, and this reduces the rate at which the liquid falls in the suction pipe 16. As a result, the suction produced in the suction pipe 16 and the back-spinning of the impellers may exist for a substantial period of time.

Figure 2:
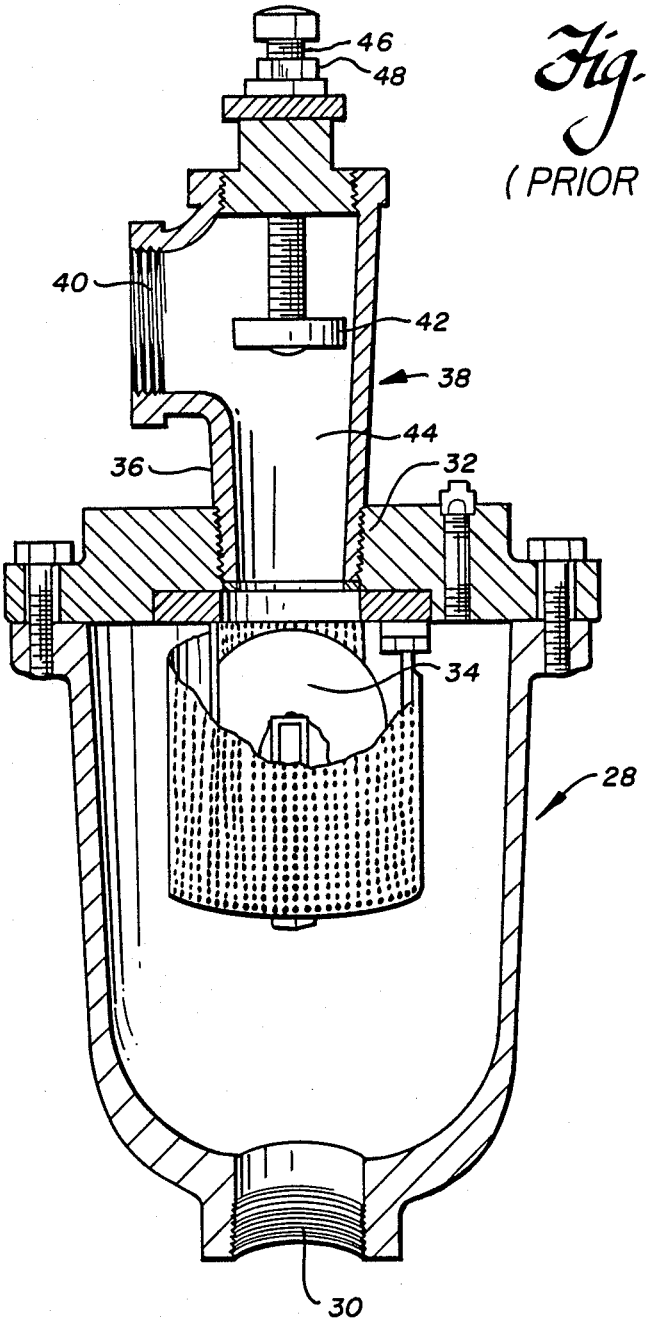
Fig. 2 (PRIOR ART)
FIG. 2 is a vertical sectional view of the prior art air and vacuum valve of FIG. 1.
Figure 3:
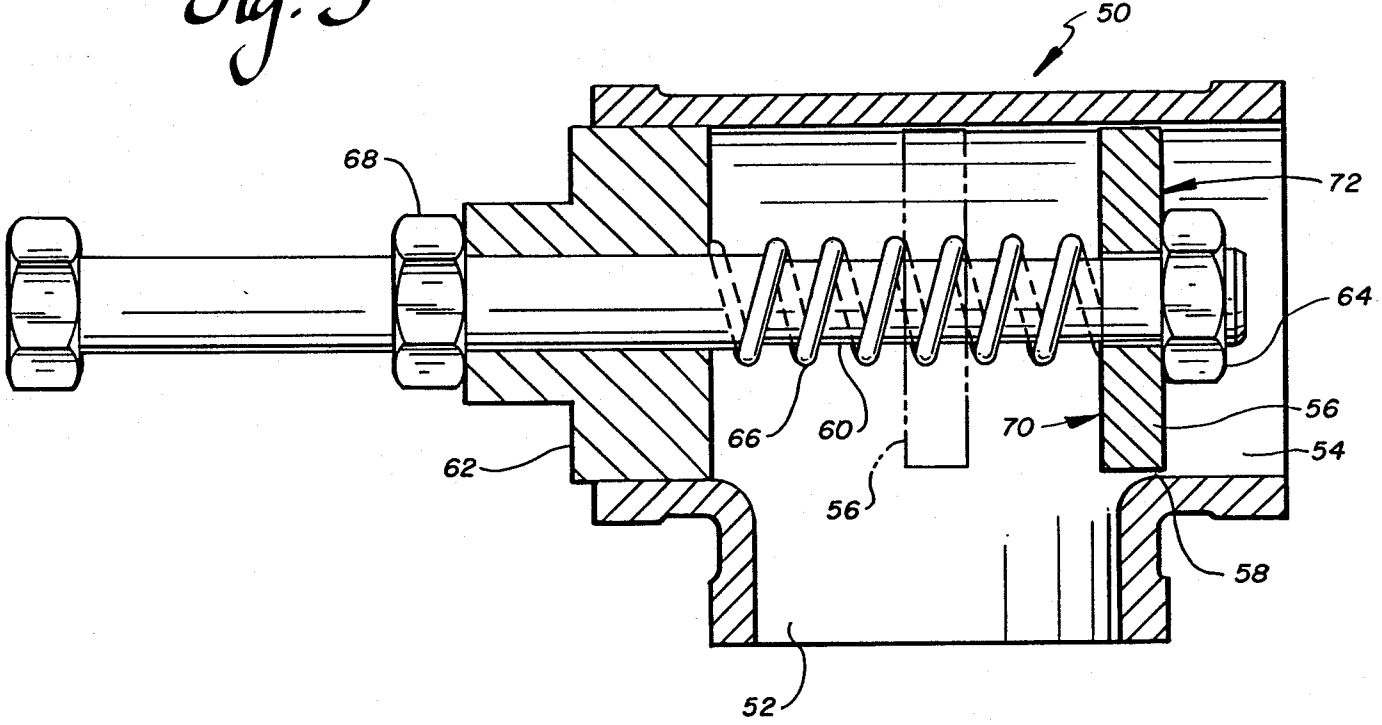
FIG. 3 is a vertical sectional view of an air throttling valve embodying the principles of the present invention.

FIG. 3 illustrates an air throttling valve 50 which, according to the principles of the present invention, automatically removes the restriction to the flow of atmospheric air into the valve 50 when pumping stops. The valve 50 has an inlet 52 which is connectable to the outlet 32 of the air and vacuum valve 28 of FIGS. 1 and 2 or to the outlet of any other air and vacuum valve which might be used in a given system. The outlet 54 of the valve 50 is in communication with the atmosphere.

Restriction of air flow in a discharge or vent direction through the outlet 54 is effected by a valve disc 56 which, in its flow-restricting position as shown in FIG. 3, is located within the outlet 54, so that air being vented passes through a narrow annular space 58 between the periphery of the valve disc 56 and the wall of the outlet 54. The valve disc 56 is slidably mounted on a rod 60 which is coaxial with the outlet 54, the outer end of the rod 60 being threaded through a plug 62 forming a part of the housing of the valve 50. The inner end of the rod 60 carries a stop member 64 in the form of a nut. A helical spring 66 surrounds the rod 60 and is maintained in compression by engagement at its ends with the plug 62 and with the inner face 70 of the valve disc 56. The spring 66 thus biases the valve disc 56 toward the stop member 64. The axial position of the rod 60 and hence the axial position of the stop member 64 relative to the outlet 54 is adjustable by loosening a lock nut 68 threaded on the rod, rotating the rod 60 relative to the plug 62 and retightening the lock nut 68. The valve disc 54 in FIG. 3 is shown in an essentially full-restriction position. Reduced restriction to flow can be effected by unscrewing the rod 60 so as to move the valve disc 56 slightly to the left, away from the outlet 54.

Operation of the air throttling valve 50 is as follows. At pump start-up, as previously described, air in the suction pipe 16 above the liquid level LL is forced by the rising water through the air and vacuum valve 28 into the inlet 52 of the throttling valve 50. The valve disc 56 remains in the FIG. 2 position as a result of the bias of the spring 66 and the force of the pressurized air on the inner face 70 of the valve disc 56. The air is consequently vented to the right through the annular space 58 and through the outlet 54 at a low rate. When the pump stops, a vacuum forms in the inlet 52 due to the falling of the liquid in the suction pipe 16 of the pump system. The pressure of the atmosphere against the outer face 72 of the valve disc 56 forces the latter to the left, against the bias of the spring 66 and out of the outlet 54, to for example the illustrated phantom position. There is now no annular restriction 58 through which atmospheric air flowing to the left must pass. Consequently, air re-entry takes place rapidly, with the result that the liquid in the suction pipe 16 falls rapidly to the liquid level LL.

What is claimed is:

1. In a pump system for pumping liquid from a body of liquid upwardly through a pipe having a lower end in communication with the discharge of a submerged pump: an air and vacuum valve connected to said pipe on the discharge side of said pump, said valve having an outlet for venting pressurized air from said pipe during pump start-up, valve means for preventing flow of pumped liquid through said outlet and for allowing re-entry of atmospheric air in response to a reduced air pressure in said pipe which results when the pump stops operating; and an air throttling valve having a housing, the housing having an inlet in flow communication with said outlet of said air and vacuum valve and an exhaust opening in flow communication with the atmosphere; and means mounted within said housing for restricting the flow of air to a first flowthrough passage through said housing to atmosphere, said means being responsive to the occurrence of a reduced air pressure in said housing to remove said flow restriction thereby allowing atmospheric air to pass through a second, larger flowthrough passage from said exhaust opening of said housing to said air and vacuum valve, whereby air is allowed to flow through said valve means and said air throttle valve during pump start-up.

2. A pump system as in claim 1 wherein said air exhaust opening of said air throttling valve opens horizontally and wherein said inlet of said air throttling valve opens downwardly, said flow-restricting means including a valve member of lesser diameter than said exhaust opening mounted on a horizontal rod for movement along the rod between a flow-restricting position within said exhaust opening and a free-flow position spaced from said exhaust opening and spring means biasing said valve member toward its flow-restricting position, whereby, upon a drop in air pressure within said valve housing, atmospheric pressure forces said valve member to move toward its full-flow position thereby providing essentially unrestricted flow of atmospheric air through said throttling valve.

3. An air throttling valve for use with an air and vacuum valve of the kind which has an outlet for venting pressurized air from a submerged pump system during pump start-up, for preventing flow of pumped liquid through the outlet and for allowing for re-entry of atmospheric air upon stopping of the pump, said air and vacuum valve being located between a pump discharge and said air throttling valve, said air throttling valve including a housing, said housing having an inlet in flow communication with the outlet of an air and vacuum valve and an exhaust opening in flow communication with the atmosphere, and means mounted within said housing for restricting the flow of air to a first flowthrough passage through said housing to the atmosphere whereby air flow to atmosphere at a low rate, said means being responsive to the occurrence of reduced air pressure in said housing to remove the restriction to air flow and allow air to pass through a second, larger flow through passage from said exhaust opening to said inlet at a high rate, whereby air is allowed to flow through said air and vacuum valve and said throttling valve during pump start-up.

4. An air throttling valve as in claim 3 wherein said air exhaust opening and said inlet open in directions at a right angle to each other, said flow-restricting means including a valve member of lesser diameter than said exhaust opening mounted for movement along a rod which is disposed coaxially with an axis of said exhaust opening, said valve member being movable along said rod between a flow-restricting position within said exhaust opening and a free-flow position spaced from said exhaust opening and spring means biasing said valve member towards its flow-restricting position, whereby, upon a drop in air pressure within said valve housing, atmospheric pressure forces said valve member to move toward its full-flow position thereby providing for essentially unrestricted flow of atmospheric air into and through said exhaust opening.

5. An air throttling valve as in claim 4 wherein said rod has a threaded portion at one end and a stop member for said valve member at the opposite end, the threaded portion of said rod protruding through a threaded bore to an outside of said housing whereby the flow-restricting position of said valve member can be varied by rotating said rod relative to said housing.

* * * * *